US006082103A

United States Patent [19]

Sugiura et al.

[11] Patent Number: 6,082,103

[45] Date of Patent: Jul. 4, 2000

[54] EXHAUST MANIFOLD, FOR INTERNAL COMBUSTION ENGINE, FOR IMPROVING DURABILITY OF OXYGEN SENSOR AT MERGING PORTION OF EXHAUST MANIFOLD

[75] Inventors: Shigeki Sugiura, Shizuoka; Takayoshi Nakagawa, Toyota; Yasuhiro Oi, Susono, all of Japan

[73] Assignee: Toyota Jidosha Kabushiki Kaisha, Toyota, Japan

[21] Appl. No.: 09/097,494

[22] Filed: Jun. 15, 1998

[30] Foreign Application Priority Data

Aug. 6, 1997 [JP] Japan ..... 9-212321

[51] Int. Cl.[7] ..... F01N 7/10

[52] U.S. Cl. ..... 60/323; 60/322; 60/272

[58] Field of Search ..... 60/323, 302, 272, 60/324, 276

[56] References Cited

U.S. PATENT DOCUMENTS

| | | | |
|---|---|---|---|
| 4,420,933 | 12/1983 | Kajitani et al. | 60/302 |
| 4,484,440 | 11/1984 | Oki et al. | 60/276 |
| 4,621,494 | 11/1986 | Fujita | 60/313 |
| 5,265,420 | 11/1993 | Rutschmann | 60/302 |
| 5,271,477 | 12/1993 | Gekka et al. | 60/302 |

FOREIGN PATENT DOCUMENTS

| | | |
|---|---|---|
| 61-184808 | 11/1986 | Japan . |
| 63-10149 | 1/1988 | Japan . |
| 1-115830 | 8/1989 | Japan . |
| 417116 U | 2/1992 | Japan . |
| 797921A | 4/1995 | Japan . |
| 8246870A | 9/1996 | Japan . |
| 8-312324 | 11/1996 | Japan . |

*Primary Examiner*—Thomas Denion
*Assistant Examiner*—Binh Tran
*Attorney, Agent, or Firm*—Kenyon & Kenyon

[57] ABSTRACT

An exhaust manifold comprising a plurality of exhaust pipes and a merging portion applies exhaust gas from each cylinder uniformly to an oxygen sensor in a merging portion at low speed thereby improving the durability of the oxygen sensor. A downstream forward end of each exhaust pipe of the exhaust manifold, when connected to an inlet wall of a merging case having the oxygen sensor mounted on a side thereof, is formed in the shape of a bell mouth for leading the exhaust gas to the oxygen sensor. Each exhaust pipe is fixedly welded to the merging case at a position upstream of the forward end of the bell mouth. An angle formed by lines perpendicular to tangential lines at starting and ending points of a curved portion of the bell mouth at the forward end of the exhaust pipe is set in the range of 45° to 75°. As a result, the bell mouth spreads over the whole interior of the merging case and reduces a flow rate of the exhaust gas, and part of the exhaust gas flows toward the oxygen sensor. The oxygen sensor is thus more evenly exposed to the exhaust gas and has increased durability.

11 Claims, 9 Drawing Sheets

(R IS TOO LARGE)

(R IS TOO SMALL)

EXHAUST MANIFOLD, FOR INTERNAL COMBUSTION ENGINE, FOR IMPROVING DURABILITY OF OXYGEN SENSOR AT MERGING PORTION OF EXHAUST MANIFOLD

BACKGROUND OF THE INVENTION

1. Field of the Invention

The present invention relates to an exhaust manifold for an internal combustion engine or, more particularly, to an exhaust manifold comprising a plurality of exhaust pipes extending from exhaust ports of an internal combustion engine and a merging portion of the exhaust pipes with an oxygen sensor arranged therein, wherein the exposure of the oxygen sensor to the exhaust gas is improved for improving the durability of the oxygen sensor 2. Description of the Related Art Conventional exhaust manifolds for internal combustion engines are made of cast iron having a comparatively large weight. In order to reduce the weight and the thermal capacity of the engine, however, the current practical trend is toward the use of an exhaust manifold comprising a plurality exhaust pipes of stainless steel mounted to exhaust ports and combined at a merging portion. An electronically-controlled internal combustion engine, on the other hand, is required to detect the air-fuel ratio in the exhaust gas to control the fuel injection amount. With the electronically-controlled internal combustion engine, therefore, an air-fuel ratio sensor (usually, an oxygen sensor) is mounted at the merging portion.

For this electronically-controlled internal combustion engine, the oxygen sensor is desirably exposed uniformly to the exhaust gas from each cylinder. In view of this, various shapes of the merging portion of the exhaust manifold have been proposed to assure that the oxygen sensor is uniformly exposed to the exhaust gas from each cylinder. According to Unexamined Patent Publication (Kokai) No. 7-97921, for example, each exhaust pipe protrudes into the merging portion with the forward end thereof curved toward the oxygen sensor or an inclined wall is formed at the exhaust gas outlet of each exhaust pipe.

The shape of the exhaust manifold disclosed in Unexamined Patent Publication (Kokai) No. 7-97921, however, is liable to reduce the durability of the oxygen sensor. The reason for the low durability is that the oxygen sensor is mounted at the merging portion in parallel to a plurality of exhaust pipes so that, in the case where the end of each exhaust pipe is curved toward the oxygen sensor or the inclined wall is formed at the exhaust gas outlet of each exhaust pipe, the high-temperature high-velocity exhaust gas directly strikes the oxygen sensor located in the neighborhood of the exhaust pipe outlets.

SUMMARY OF THE INVENTION

The object of the present invention is to provide an exhaust manifold, for an internal combustion engine, in which an oxygen sensor is mounted downstream of the exhaust gas flow at a distance from the merging portion where a plurality of exhaust pipes are mounted, and in which the oxygen sensor is uniformly exposed to a low-velocity exhaust gas from each cylinder for an improved durability of the oxygen sensor.

In order to achieve the above-mentioned object, according to a first aspect of the invention, there is provided an exhaust manifold of an internal combustion engine, comprising a plurality of exhaust pipes and a merging case, in which each of the exhaust pipes is formed with an end thereof connected to an exhaust port of the internal combustion engine and the other end thereof connected to the merging case, in which an oxygen sensor is arranged downstream of the connected portion of the exhaust pipes in the merging case, and in which the shape of the end of each exhaust pipe connected to the merging case is in the shape of bell mouth for leading the exhaust gas to the oxygen sensor In this case, each exhaust pipe can be fixedly welded to the merging case at a position upstream of the bell-mouthed end thereof. In addition, each exhaust pipe can be comprised of a double structure including an inner pipe and an outer pipe with the latter welded to the merging case and the former having a bell-mouthed end Further, the bell-mouthed curved portion can be so shaped that the two lines perpendicular to the tangential lines at the starting point and the ending point of the particular curved portion form an angle in the range of 45° to 75° to each other.

In order to achieve the above-mentioned object, according to a second aspect of the invention, there is provided an exhaust manifold, for an internal combustion engine, comprising a plurality of exhaust pipes and a merging case, in which each of the exhaust pipes is formed with an end thereof connected to an exhaust port of the internal combustion engine and the other end thereof connected to the merging case, in which an oxygen sensor is arranged downstream of the connected portion of the exhaust pipes in the merging case, in which a guide member having a plurality of through holes corresponding to the exhaust gas passages of the exhaust pipes is mounted on the inner wall surface of the merging case connected with the exhaust pipes, and in which each of the through holes of the guide member is in the shape of bell mouth for leading the exhaust gas to the oxygen sensor.

In the aforementioned case, the center of the bell mouth is offset. Also, a catalyst can be arranged downstream of the oxygen sensor with the axial line of each exhaust pipe inclined at an angle to the center line of the merging case.

In the first aspect of the invention, the exhaust gas flows toward the oxygen sensor and is dispersed over the entire area by the bell mouth. The velocity of the exhaust gas, therefore, is reduced and thus the exposure of the oxygen sensor to the exhaust gas can be improved without reducing the durability of the oxygen sensor. Also, since the merging case is welded upstream of the bell mouth, the welding circle is not excessively large and no misalignment occurs at the connection between each exhaust pipe and the merging case. As a result, a satisfactory shape of bell mouth is obtained and the exhaust gas comes suitably into contact with the oxygen sensor Further, in the case where the curved portion of the bell mouth is so shaped that the two lines perpendicular to the tangential lines at the starting point and the ending point of the particular curved portion form an angle in the range of 45° to 75° to each other, then both the pressure loss and the reverse flow of the exhaust gas in the neighborhood of the inner wall of the merging case can be reduced at the same time According to the second aspect of the invention in which a bell mouth is formed of an independent solid guide member made of metal, both the rigidity of the bell-mouthed portion and the heat conductivity are improved.

In any of the above-mentioned aspects of the invention, an irregular peripheral shape of the bell mouth can control the exhaust gas flow in accordance with the shape of the merging case, and therefore the pressure loss can be reduced Further, in any of the above-mentioned aspects of the invention, a catalyst arranged downstream of the oxygen sensor and the axial line of each exhaust pipe inclined with respect to the center line of the merging case makes it possible to assure that the central portion of the catalyst is exposed to the exhaust gas of high velocity and increases in temperature. Thus it is possible to reduce the temperature gradient from the low-temperature exterior of the catalyst in proximity to the atmosphere

BRIEF DESCRIPTION OF THE DRAWINGS

The present invention will be more clearly understood from the description as set forth below with reference to the accompanying drawings, in which.

DESCRIPTION OF THE PREFERRED EMBODIMENTS

An exhaust manifold of an internal combustion engine according to a specific embodiment of the invention will be described in detail below with reference to the accompanying drawings.

Figure 1:
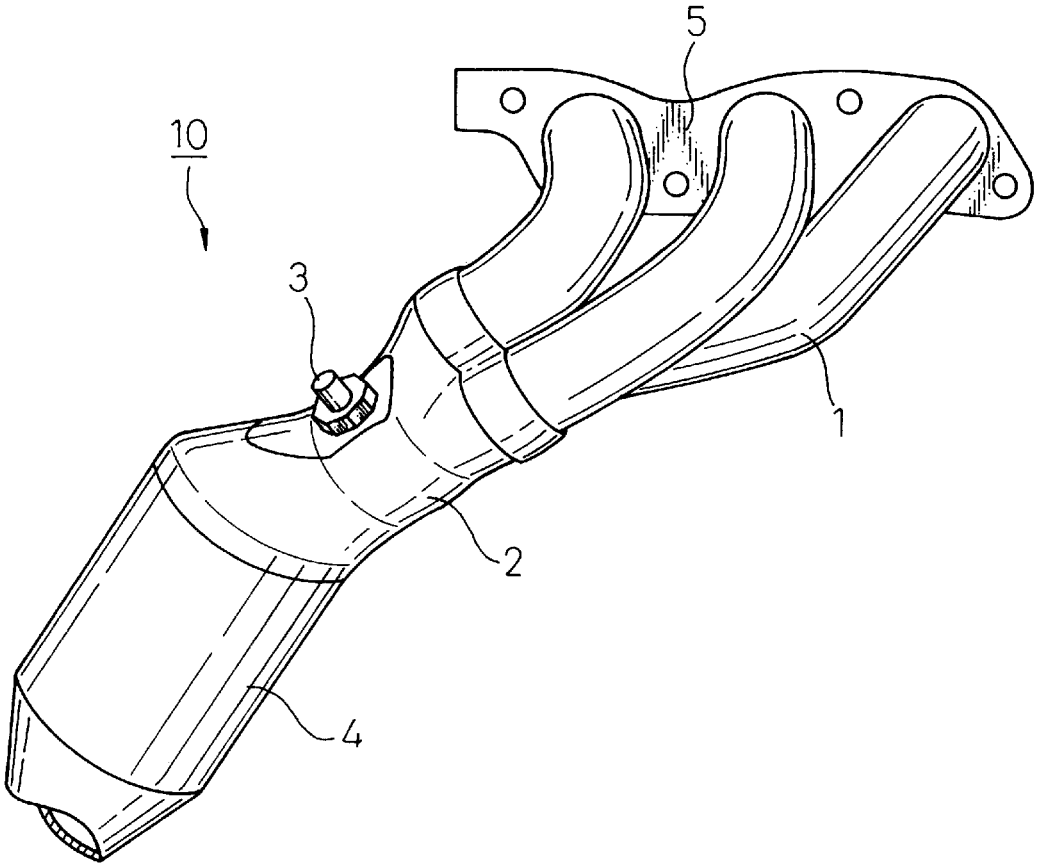
FIG. 1 is a perspective view showing a general configuration of an exhaust manifold of an internal combustion engine according to the invention.

FIG. 1 shows a general configuration of an exhaust manifold 10 of an engine according to the invention. This exhaust manifold 10 is mounted at positions corresponding to three front cylinders of an in-line six-cylinder engine, for example. The exhaust manifold 10 of this embodiment thus includes three exhaust pipes 1, a merging case 2 for merging an end of each of the three exhaust pipes 1, and a flange 5 on which the other end of each of the three exhaust pipes 3 is mounted. The flange 5 is mounted on the cylinder block of the engine for connecting the exhaust pipes 1 to the exhaust port of the engine. An oxygen sensor 3 for detecting the oxygen concentration of the exhaust gas flowing in the exhaust pipes 1 is mounted on the side of the merging case 2 with an inlet thereof connected to the three exhaust pipes 1. Also, a catalyst 4 for purifying the exhaust gas is connected to the outlet of the merging case 2.

A detailed structure of the connecting portion between the exhaust pipes 1 and the merging case 2 of the exhaust manifold 10 configured as described above will be described in detail with reference to the various embodiments cited below.

Figure 2A:
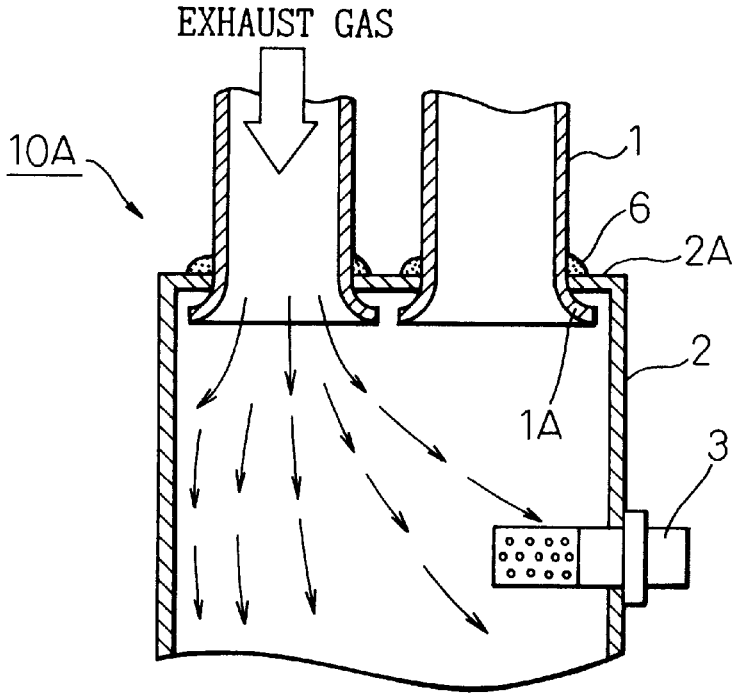
FIG. 2A is a partly enlarged sectional view showing a configuration of an exhaust manifold of an engine according to a first embodiment of the invention.

FIG. 2A shows a configuration of an exhaust manifold 10A according to a first embodiment of the invention and is a partly enlarged sectional view showing the exhaust pipes 1 and the inlet portion of the merging case 2. According to the first embodiment, the forward end 1A of the three exhaust pipes 1 connected to the inlet wall surface 2A of the merging case 2 is protruded inward of the wall surface 2A, and this forward end 1A is formed in the shape of a forwardly-expanding trumpet, i.e. in what is called the shape of a bell mouth. Each of the exhaust pipes 1 is fixedly welded to the merging case 2 at point 6 upstream of the bell-mouthed forward end 1A along the flow of the exhaust gas.

In the case where the forward end 1A of a plurality of exhaust pipes 1 connected to the merging case 2 is formed in the shape of bell mouth as described above, the flow of the exhaust gas emitted from the cylinders in the exhaust stroke is dispersed in the directions of arrows by the forward end 1A of the bell mouth. As a result, the exhaust gas spreads over the whole interior of the merging case 2, and comes into direct contact with the oxygen sensor 3 mounted on the side of the merging case 2. Also, the velocity of the exhaust gas flowing in the neighborhood of the oxygen sensor 3 is considerably lower than when flowing in the exhaust pipe 1 due to the dispersion. Therefore, the energy applied to the oxygen sensor 3 is decreased, and the fatigue failure of the oxygen sensor 3 exposed to the exhaust gas is reduced, thereby improving the durability of the oxygen sensor 3. Further, since the whole interior of the merging case 2 is used effectively as an exhaust gas passage, the pressure loss is reduced.

Figure 2B:
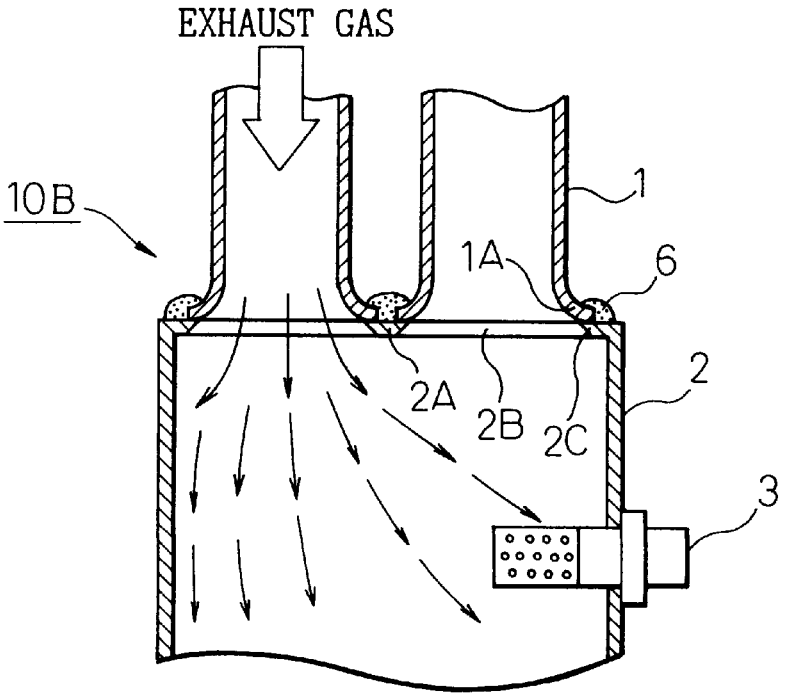
FIG. 2B is a partly enlarged sectional view showing a configuration of an exhaust manifold of an engine according to a modification of the first embodiment of the invention.

Furthermore, the bell-mouthed forward end 1A of the exhaust pipe in the merging case 2 permits the diameter of the forward end 1A to increase, and makes it possible for the exhaust gas to flow smoothly along the profile of the bell mouth FIG. 2B shows a configuration of the same parts as in FIG. 2A of an exhaust manifold 10B according to a modification of the first embodiment of the invention. In the exhaust manifold 10A according to the first embodiment, the forward end of the exhaust pipes 2 is protruded into the merging case 2. With the exhaust manifold 10B according to the modification of the first embodiment, on the other hand, the forward end 1A of the exhaust pipe 1 formed in the shape of bell mouth as in the first embodiment is mounted by welding at points 6 of the outer surface of the inlet wall 2A of the merging case 2. If the forward end 1A of the exhaust pipe 1 is simply mounted by welding at point 6 around an entrance hole 2B formed in the inlet wall surface 2A of the merging case 2, a misalignment would develop undesirably at the forward end of the bell mouth due to the thickness of the inlet wall surface 2A and would disturb the exhaust gas flow. In order to eliminate this inconvenience, according to this embodiment, a taper 2C is formed at the peripheral edge of each inlet port 2B to prevent the exhaust gas flow from being disturbed in the merging case 2.

Figure 3A:
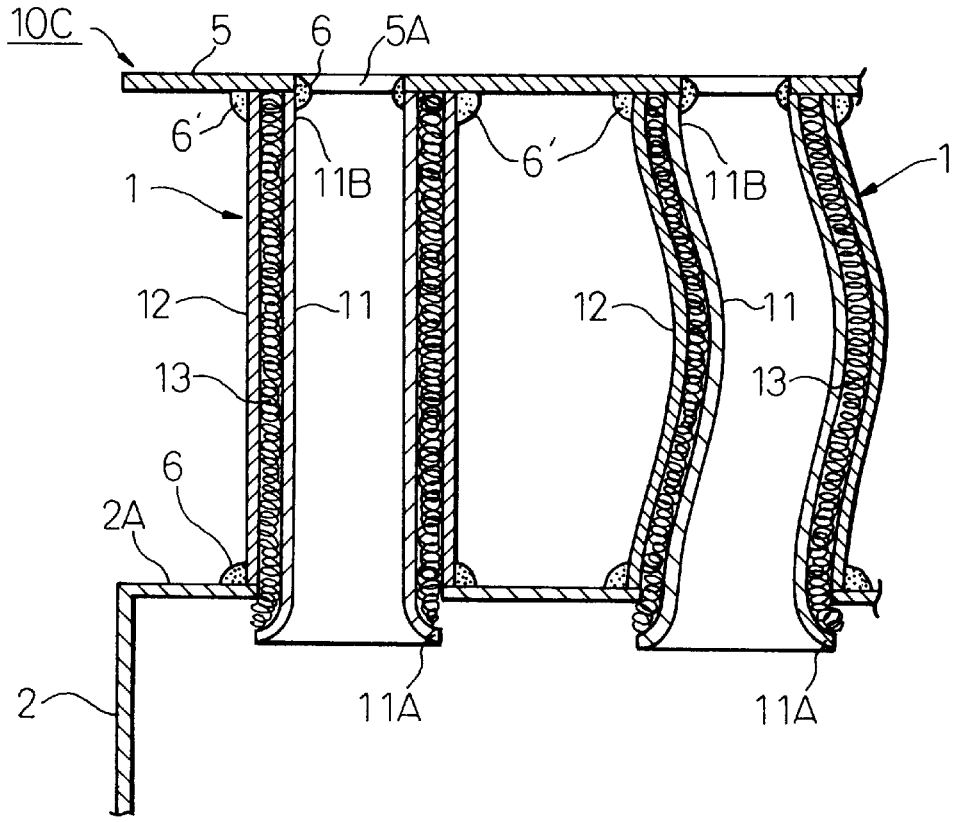
FIG. 3A is a partly enlarged sectional view showing a configuration of an exhaust manifold of an engine according to a second embodiment of the invention.

The exhaust manifold 10B according to the modification of the first embodiment has a similar effect to the first embodiment and, further, is easier to assemble on the merging case 2 of the exhaust pipe 1 than in the first embodiment FIG. 3A, which shows a configuration of an exhaust manifold 10C according to the second embodiment of the invention, is a partly enlarged sectional view of the exhaust pipe 1, the flange 5 and part of the inlet of the merging case 2. The exhaust manifold 10C according to the second embodiment is different from the exhaust manifold 10A of the first embodiment in that the exhaust pipe is formed in a double structure Each exhaust pipe 1 has a double structure of an inner pipe 11 and an outer pipe 12. A buffer member 13 of a wire net or the like is inserted between the inner pipe 11 and the outer pipe 12. The inner pipe 11 has a forward end 11A thereof protruded into the merging case 2. The forward end 11A is formed in the shape of bell mouth as in the first embodiment. The rear end 11B of the inner pipe 11 is fixed by welding at point 6 to a through hole 5A formed in the flange 5. The outer pipe 12, in contrast, is coupled by welding at point 6 to the inlet wall surface 2A of the merging case 2 on the one hand and welded at point 6' to the flange 5 on the other hand.

As described above, the exhaust manifold 10C according to the second embodiment in which the exhaust pipe 1 has a double structure and the inner pipe 11 of the exhaust pipe 1 is not welded to the merging case 2 has, in addition to the advantage of the exhaust manifold 10A of the first embodiment, the advantage that the stress due to the thermal deformation of the inner pipe 11 is not easily transmitted to the merging case 2 and therefore the thermal deformation of the merging case 2 is suppressed.

Figure 3B:
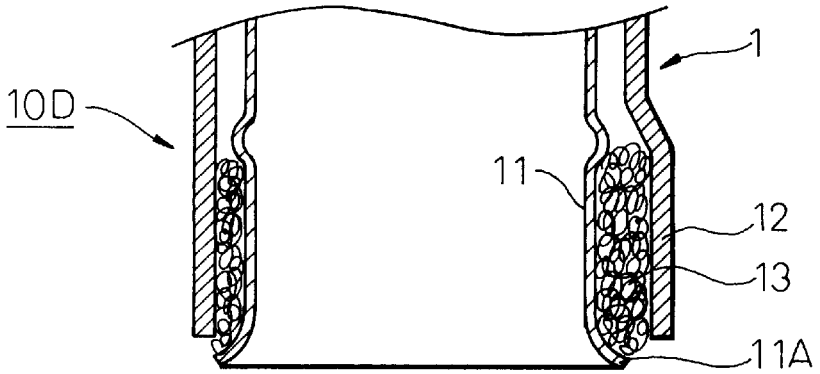
FIG. 3B is a partly enlarged sectional view showing a configuration of an exhaust manifold of an engine according to a modification of the second embodiment of the invention.

FIG. 3B shows a configuration of an exhaust manifold 10D according to a modification of the second embodiment of the invention and is a partly enlarged sectional view of the forward end 11A of the exhaust pipe 1. In this modification, the buffer member 13 is arranged only at the forward end 11A of the exhaust pipe 1 including the inner pipe 11 and the outer pipe 12.

In the case where the rear end of the outer pipe 12 of the exhaust pipe 1 is welded to the flange 5, for example, to prevent relief of the exhaust gas, the buffer member 13 can be done without.

Explanation will be given in detail of the bell mouth formed at the forward end 1A of the exhaust pipe 1 according to the invention.

Figure 4A:
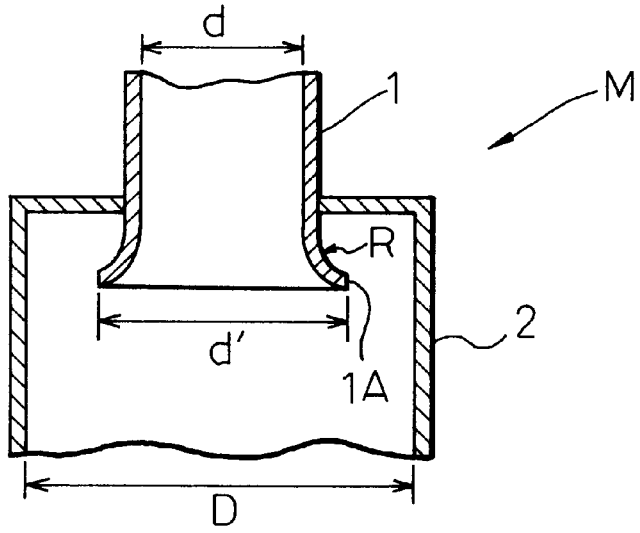
FIG. 4A is a model diagram with reference numerals attached to the parts for defining the shape of an exhaust pipe of the exhaust manifold of an engine according to the invention.
Figure 4B:
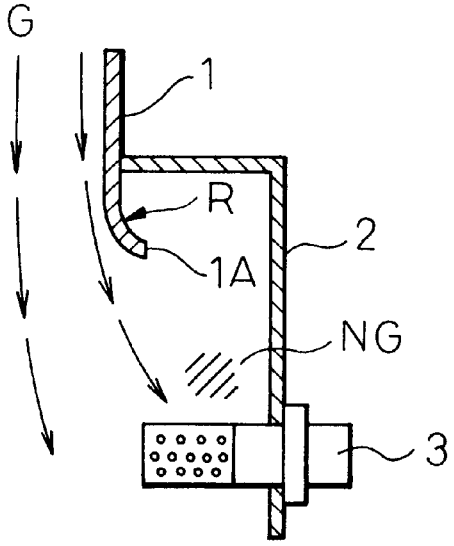
FIG. 4B is a partial sectional view for explaining the problem points posed when R in FIG. 4A is excessively large.
Figure 4C:
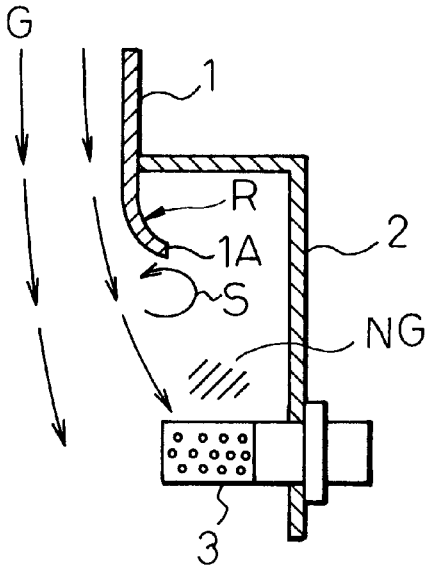
FIG. 4C is a partial sectional view for explaining the problem points posed when R in FIG. 4A is excessively small.

FIG. 4A shows a model M of the exhaust manifold with the inner diameter d of the exhaust pipe 1, the maximum diameter d' of the bell-mouthed forward end 1A of the exhaust pipe 1, the inner diameter D of the merging case 2 and the radius of curvature R of the bell mouth. As shown in FIG. 4B, in the case where the radius of curvature R of the bell mouth of the forward end 1A of the exhaust pipe is excessively large, the flow of the exhaust gas G entering the merging case 2 spreads less, with the result that a portion NG is undesirably formed in which the exhaust gas G fails to flow around the mounting base of the oxygen sensor 3. In the case where the radius of curvature R of the bell mouth at the forward end 1A of the exhaust pipe is excessively small as shown in FIG. 4C, in contrast, the exhaust gas G fails to flow along the profile of the bell mouth and an eddy current (swirl) S develops in the neighborhood of the forward end 1A of the exhaust pipe. The swirl S decreases the spread of the flow of the exhaust gas G entering the merging case 2 with the result that there develops a portion NG where the exhaust gas G fails to flow around the mounting base of the oxygen sensor 3.

From the the foregoing description, it will be seen that the oxygen sensor is not sufficiently exposed to the exhaust gas depending on the shape of the bell mouth formed at the forward end 1A of the exhaust pipe, sometimes making it impossible to produce the desired effect.

Figure 5A:
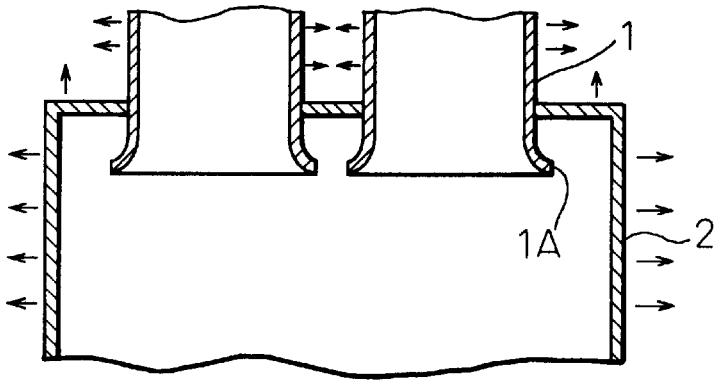
FIG. 5A is a diagram for explaining the reason why an end of each exhaust pipe of the exhaust manifold of an engine according to the invention is liable to develop a thermal deformation.
Figure 5B:
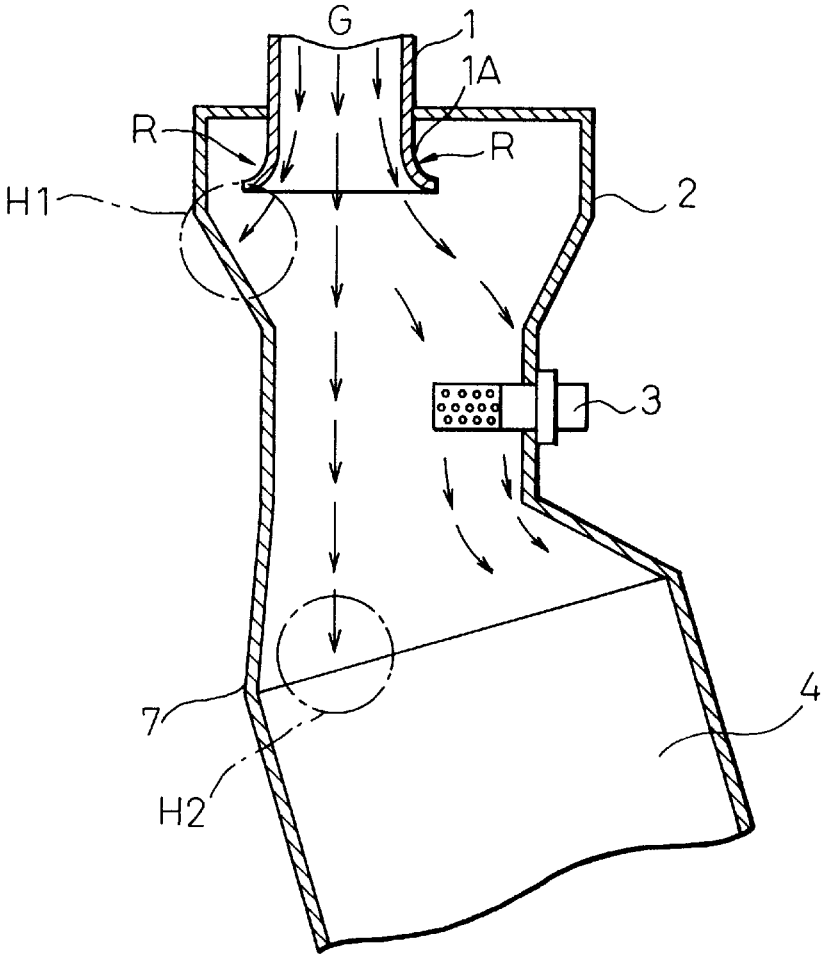
FIG. 5B is a partly enlarged sectional view for explaining the problem points posed in the case where the axial line of the exhaust pipe connected to the merging case forms a predetermined angle with the axial line of the catalyst located downstream in the merging case.

The forward end 1A of the exhaust pipe, unlike the other portions of the exhaust pipe 1, is kept in contact with the high-temperature exhaust gas with the heat contained over the entire area thereof. The merging case 2 and portions other than the forward end 1A of the exhaust pipe 1, in contrast, as shown in FIG. 5A, are in contact with the atmosphere and therefore can lose the heat to the atmosphere. As a result, the forward end 1A of the exhaust pipe has a higher chance of being thermally damaged than the other portions thereof Further, as shown in FIG. 5B, in the case where the axial line of the exhaust pipe 1 connected to the merging case 2 forms a predetermined angle with the axial line of the catalyst 4 located downstream of the merging case 2, a bell mouth uniformly formed at the forward end 1A of the exhaust pipes 1 would strongly expose portions H1 and H2 to the exhaust gas G, leading to an increased pressure loss.

Specifically, the flow of the exhaust gas G spread into the shape of bell mouth impinges strongly on the oblique wall portion of the merging case 2 in the portion H1, and the fastest moving portion of the exhaust gas G emitted from the neighborhood of the axial line of the exhaust pipe 1 flows along the side wall of the merging case 2 and impinges on the portion of the catalyst 4 in the vicinity of the catalyst case 7 in the portion H2.

The portion of the catalyst 4 in the vicinity of the catalyst case 7, on the other hand, is cooled by the catalyst case 7 in contact with the atmosphere. Consequently, the portion of the catalyst 4 contacting the fastest moving portion of the exhaust gas G increases in temperature and develops a large temperature gradient, often deteriorating the heat resistance of the catalyst 4.

Figure 6A:
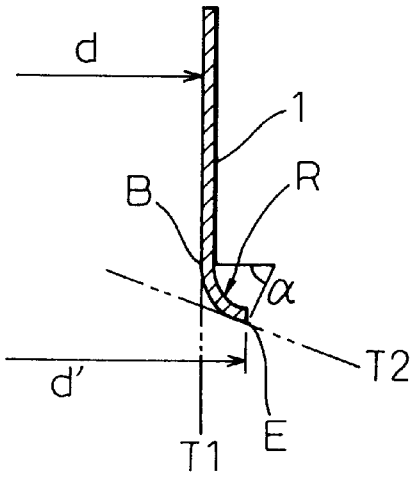
FIG. 6A is a partial sectional view showing various parts designated by reference numerals for defining the shape of the exhaust pipe of an exhaust manifold of an engine according to the invention.

In order to prevent the above-mentioned inconvenience, in a model as shown in FIG. 6A and with respect to lines perpendicular to the tangential lines T1, T2, respectively, at the starting point B and the ending point E of the bell-mouthed curved portion at the forward end 1A of the exhaust pipe 1 the angle $\alpha$ formed by the two perpendicular lines is appropriately set to define the starting point B and the ending point E of the bell-mouthed curved portion. The ratio d'/d of the maximum diameter d' of the bell-mouthed forward end 1A of the exhaust pipe 1 to the inner diameter d of the merging case 2 is set in the range of 1.1 to 1.5 to meet the fabrication and mounting conditions. The angle $\alpha$ may preferably be set in the range between 45° and 75°.

Figure 6B:
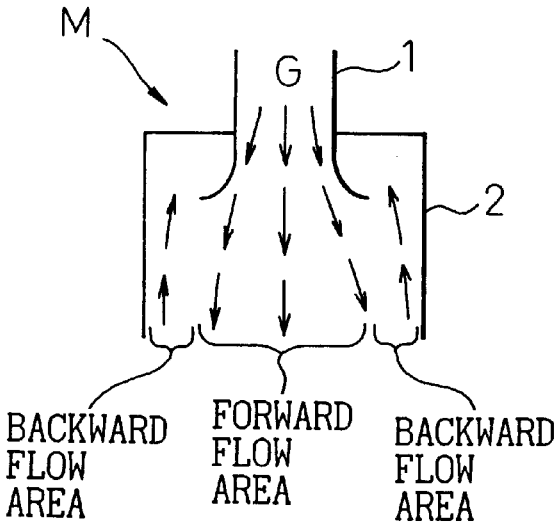
FIG. 6B is a diagram for explaining the flow of the exhaust gas in the merging case of an exhaust manifold of an engine according to the invention.

When the model M of the exhaust manifold described with reference to FIG. 4A is supplied with the exhaust gas G, a forward flow area and a reverse flow area as shown in FIG. 6B were seen to develop in the model M of the exhaust manifold. It was also discovered that the ratio between the forward flow area and the reverse flow area generated in the model M of the exhaust manifold can be differentiated by changing the angle $\alpha$. Further, the pressure loss in the model M of the exhaust manifold can be differentiated by changing the angle $\alpha$.

Figure 6C:
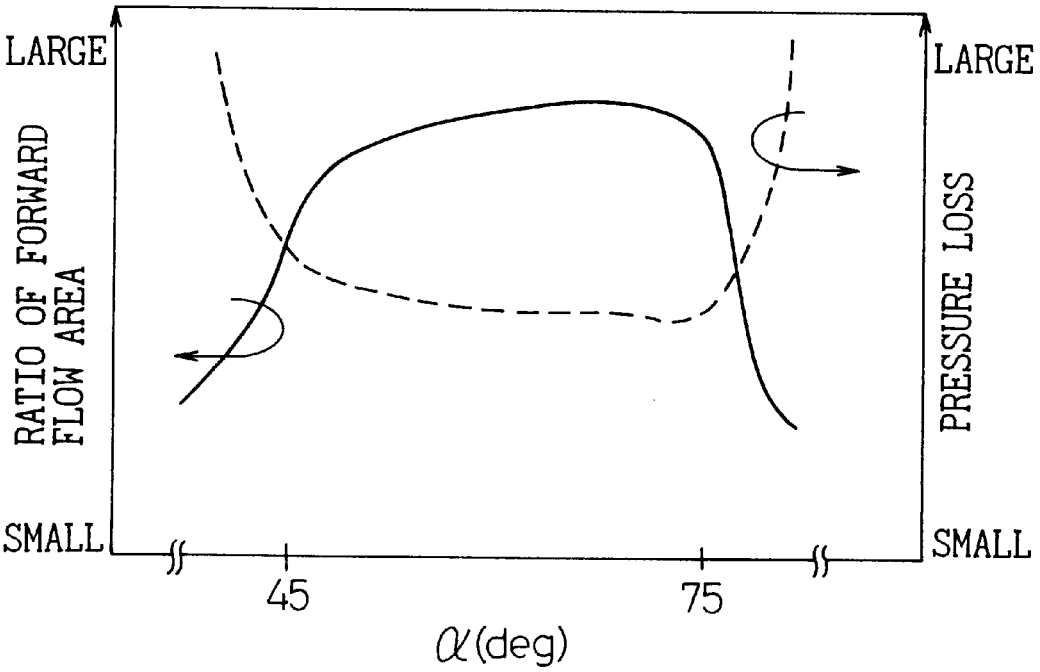
FIG. 6C is a characteristic diagram showing the ratio of the forward flow area in the merging case versus the pressure loss with varied angles between the lines perpendicular to the tangential lines at the starting point and the ending point of the bell mouth formed at the forward end of the exhaust pipe of the exhaust manifold of an engine according to the invention.

FIG. 6C is a characteristic diagram showing the ratio of the forward flow area in the merging case 2 versus the pressure loss with the angle $\alpha$ changed between the lines perpendicular to the tangential lines at the starting point B and the ending point E of the bell-mouthed curved portion at the forward end 1A of the exhaust pipe of the model M of the above-mentioned exhaust manifold. As seen from this diagram, the ratio of the forward flow area and the pressure loss assume satisfactory values when the angle $\alpha$ formed by the lines perpendicular to the tangential lines at the starting point B and the ending point E of the bell-mouthed curved portion at the forward end 1A of the exhaust pipe is in the range of 45° to 75°. Consequently, the angle $\alpha$ formed by the lines perpendicular to the tangential lines at the starting point B and the ending point E of the bell-mouthed curved portion at the forward end 1A of the exhaust pipe is properly set in the range of 45° to 75°.

Figure 7A:
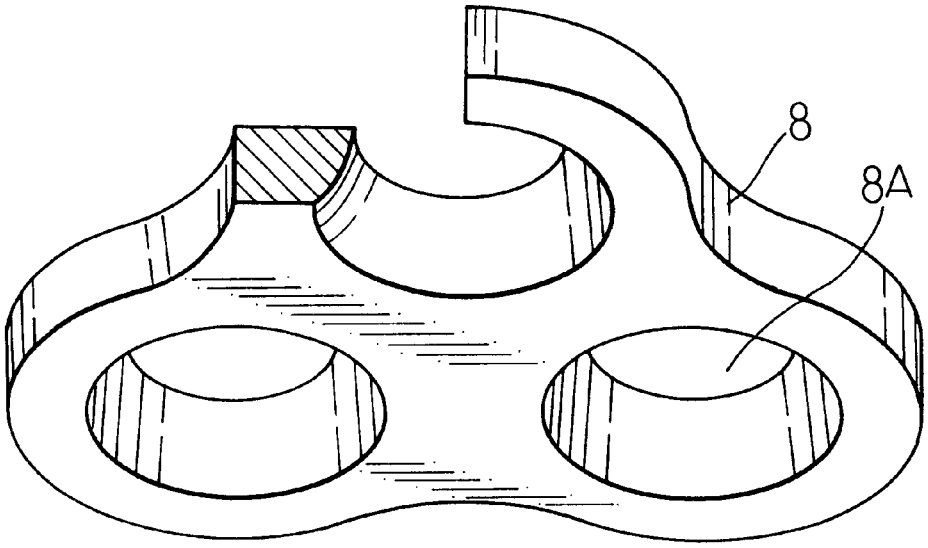
FIG. 7A is a partly-cutaway perspective view showing the shape of a guide member used in a third embodiment of the invention.
Figure 7B:
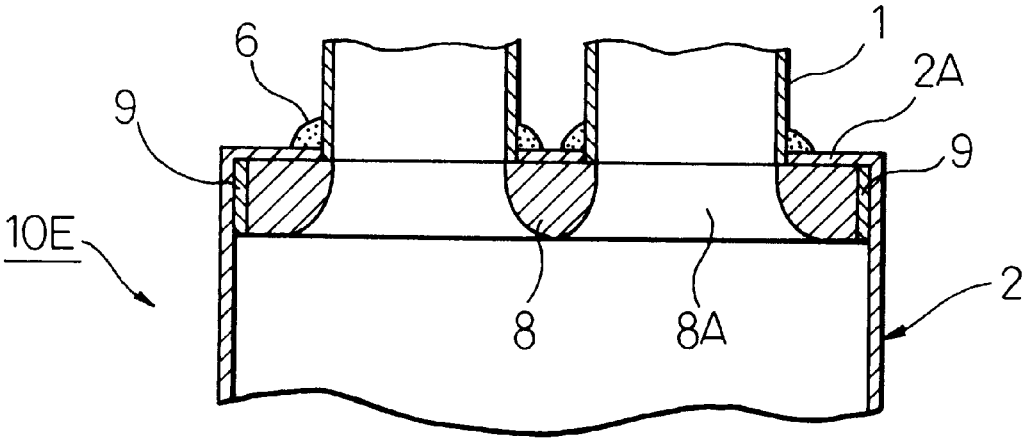
FIG. 7B is a partly enlarged sectional view showing a configuration of an exhaust manifold of an engine using the guide member of FIG. 7A according to the third embodiment of the invention.

FIG. 7A shows the shape of a guide member 8 used for an exhaust manifold 10E according to a third embodiment of the invention. The guide member 8, as shown in FIG. 7B, is mounted by being welded at portions 9 on the inner surface of the inlet wall 2A of the merging case 2. The guide member 8 has a uniform thickness and has substantially the same outer peripheral shape as the inner peripheral shape of the merging case 2. The guide member 8, as mounted on the inner surface of the inlet wall 2A of the merging case 2, includes through holes 8A each having the same size as the inner diameter of the exhaust pipe 1 connected by welding as designated by numeral 6 on the outer surface of the inlet wall 2A of the merging case 2. The inner peripheral surface of each through hole 8A is in the shape of bell mouth as a part thereof is shown in the sectional view of FIG. 7A.

The guide member 8 including the through holes 8A having the bell-mouthed inner peripheral surface and mounted on the inner surface of the inlet wall 2A of the merging case 2 has the same effect as the forward end 1A of the exhaust pipe 1, described with reference to the first embodiment, formed in the shape of bell mouth. The guide member 8 according to the third embodiment, on the other hand, constitutes a part independent of the merging case 2 and has the outer peripheral surface thereof connected by welding to the merging case 2 as designated by numeral 9

Consequently, regarding the exhaust manifold 10E according to the third embodiment, even in the case where the guide member 8 is heated by the exhaust gas, the heat applied to the guide member 8 can be released through the merging case 2. Also, the exhaust manifold 10E according to the third embodiment, as compared with the bell-mouthed forward end 1A of the exhaust pipe according to the first embodiment, has a higher strength due to the mass of the guide member 8. Also, the larger thermal capacity reduces the chance of thermal damage as compared with the first embodiment.

Figure 8A:
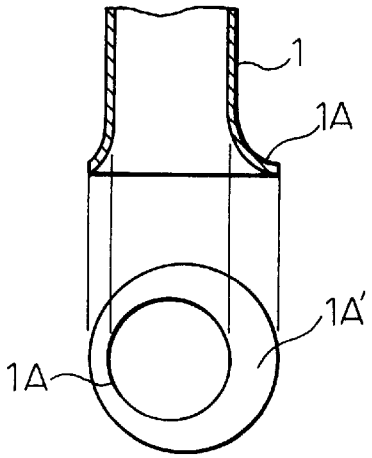
FIG. 8A is a bottom view and a side sectional view showing the shape of the forward end of the exhaust pipe for explaining the configuration of the exhaust manifold of an engine according to a fourth embodiment of the invention.
Figure 8B:
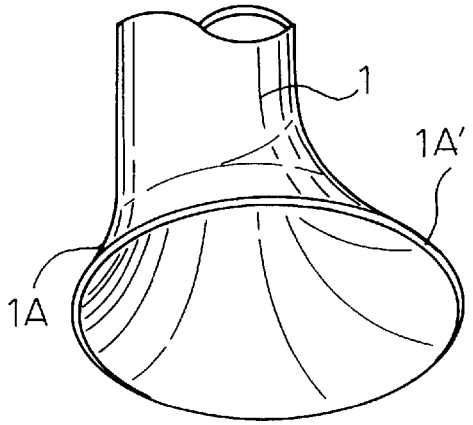
FIG. 8B is a perspective view showing the shape of the forward end of the exhaust pipe of FIG. 8A.
Figure 8C:
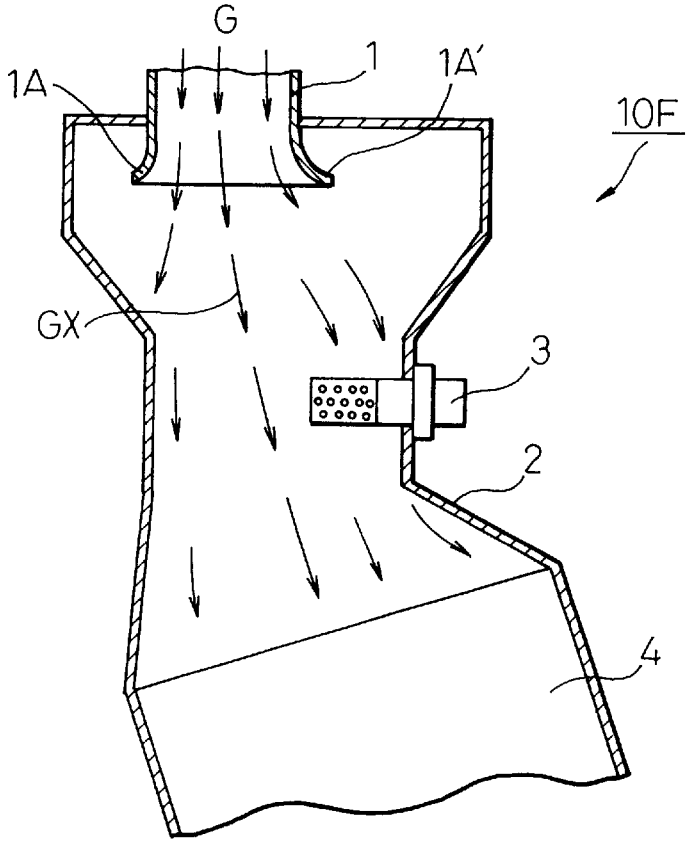
FIG. 8C is a partial sectional view showing a configuration of an exhaust manifold according to the fourth embodiment of the invention in which the axial line of the exhaust pipe connected to the merging case forms a predetermined angle with the axial line of the catalyst located downstream in the merging case.

FIGS. 8A to 8C show a configuration of an exhaust manifold 10F according to a fourth embodiment of the invention, in which the axial line of the exhaust pipe 1 connected to the merging case 2 forms a predetermined angle with the axial line of the catalyst 4 located downstream of the merging case 2. FIG. 8A shows the shape of the forward end 1A of the exhaust pipe 1, FIG. 8B the outer appearance of the forward end 1A of the exhaust pipe of FIG. 8A, and FIG. 8C the exhaust manifold 10F with the exhaust pipe 1 of FIGS. 8A, 8B connected to the merging case 2.

According to the fourth embodiment, as shown in FIGS. 8A, 8B, the bell mouth formed at the forward end 1A of the exhaust pipe is not uniform and a portion of the bell mouth has a larger radius of curvature than the remaining portion. The exhaust gas flowing along the bell mouth portion of larger radius of curvature spreads farther. According to the fourth embodiment, therefore, as shown in FIG. 8C, the exhaust pipe 1 is mounted on the merging case 2 in such a manner that the forward end portion 1A' of the exhaust pipe having a larger radius of curvature of the bell mouth is directed toward the oxygen sensor 3.

Consequently, with the exhaust manifold 10F according to the fourth embodiment, the shape of the bell mouth lacking uniformity causes the portion of the exhaust gas G flowing at maximum velocity GX through the exhaust pipe 1 to be curved away from the axial line of the exhaust pipe 1 toward the forward end portion 1A' of the exhaust pipe having a larger radius of curvature of the bell mouth. Therefore, the exhaust gas portion G having the maximum velocity GX reaches the neighborhood of the center of the catalyst 4. Also, the exhaust gas portion flowing toward the forward end portion 1A' of the exhaust pipe having a larger radius of curvature of the bell mouth, on the other hand, spreads to such an extent in the merging case 2 as to come into full contact with the oxygen sensor 3.

Figure 9:
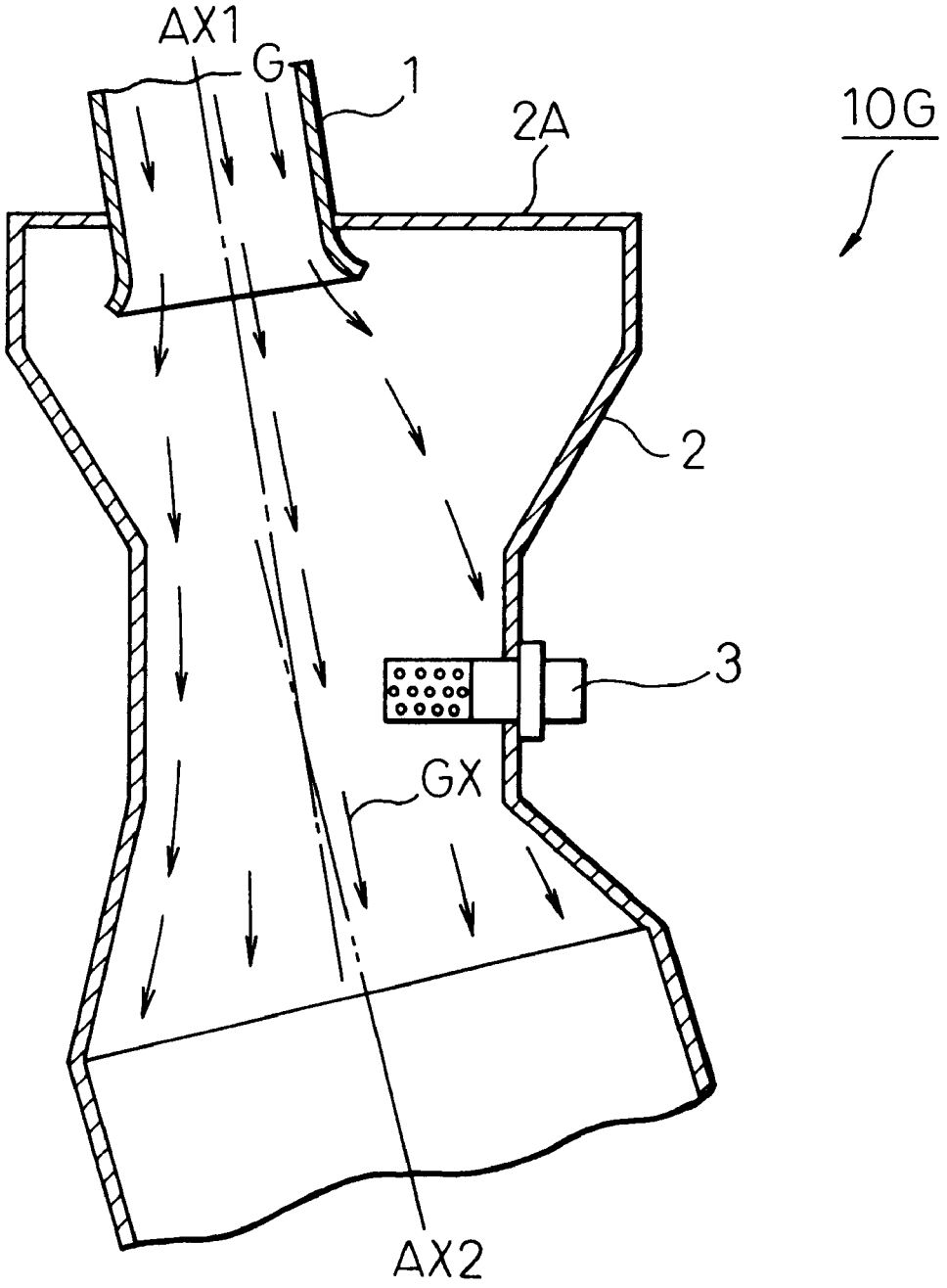
FIG. 9 is a partly enlarged sectional view showing a configuration of an exhaust manifold, for an engine, according to a fifth embodiment of the invention.

As described above, an irregular shape of the bell-mouthed forward end 1A of the exhaust pipe makes it possible to control the direction of outflow and dispersion of the exhaust gas from the exhaust pipe 1. Even in the case where the axial line of the exhaust pipe 1 connected to the merging case 2 fails to coincide with the axial line of the catalyst 4 located downstream of the merging case 2, therefore, the exhaust manifold 10F according to this embodiment can fully exhibit the effects thereof FIG. 9 shows a configuration of an exhaust manifold 10G according to a fifth embodiment of the invention. As in the fourth embodiment, the axial line of the exhaust pipe 1 connected to the merging case 2 forms a predetermined angle with the axial line of the catalyst located downstream of the merging case 2.

According to the fifth embodiment, the bell-mouthed portion formed at the forward end 1A of the exhaust pipe has a uniform shape like the first embodiment. In the first to fourth embodiments, the exhaust pipe 1 is mounted perpendicular to the inlet wall 2A of the merging case 2. In the fifth embodiment, in contrast, each exhaust pipe 1 is mounted at an angle to the inlet wall surface 2A of the merging case 2. The direction in which the exhaust pipe 1 is tilted with respect to the inlet wall surface 2A is such that the axial line AX1 of the exhaust pipe 1 substantially coincides with the axial line AX2 of the catalyst 4

In the exhaust manifold according to the fifth embodiment having this configuration, the fastest moving portion GX of the exhaust gas G flows from the exhaust pipe 1 into the merging case 2 toward the central portion of the catalyst 4, and therefore the flow of the fastest moving portion GX of the exhaust gas G reaches the center of the catalyst 4 or the vicinity thereof. As a result, the distance between the low-temperature exterior of the catalyst 4 in contact with the atmosphere and the central portion thereof highest in temperature associated with the fastest moving portion GX can be lengthened, thereby reducing the temperature gradient for an improved heat resistance. Also, the oxygen sensor 3 is fully exposed to the exhaust gas as it is located along the direction of the flow of the exhaust gas spreading in the merging case 2 from the forward end 1A of the bell-mouthed exhaust pipe As described above, an exhaust pipe 1 having a uniform shape of bell mouth at the forward end 1A thereof is mounted on the merging case 2 with the axial line AX1 thereof substantially in alignment with the axial line AX2 of the catalyst 4. Therefore, it is possible to control the directions of flow and dispersion of the exhaust gas flowing in the exhaust pipe 1. As a result, the exhaust manifold 10G according to this embodiment can exhibit a full effect even in the case where the axial line of the exhaust pipe 1 connected to the merging case 1 fails to coincide with the axial line of the catalyst 4 located downstream of the merging case 2.

The above-mentioned embodiments refer to the exhaust manifold mounted in association with the three front cylinders of a six-cylinder engine. The exhaust manifold of the engine according to the present invention, however, is not limited to the number of engine cylinders or the front or rear position thereof.

What is claimed is:

1. An exhaust manifold for a multi-cylinder internal combustion engine comprising:

a merging case;

a plurality of exhaust pipes, each of the exhaust pipes having a connected end connected to a corresponding exhaust port of the engine and a connecting portion at a downstream end, the connecting portion of each exhaust pipe being connected to the merging case;

an oxygen sensor positioned in the merging case downstream of the connecting portions of the exhaust pipes wherein the downstream end of each of the exhaust pipes is shaped as a bell mouth for leading exhaust gas to the oxygen sensor.

2. An exhaust manifold for an engine according to claim 1, wherein each of the exhaust pipes is fixedly welded to the merging case at a position upstream of the bell-mouthed downstream end.

3. An exhaust manifold for an engine according to claim 2, wherein each of the exhaust pipes includes an inner pipe and an outer pipe, each of the outer pipes being coupled by welding to the merging case, wherein the bell mouth of each of the exhaust pipes is formed only at a downstream end of each of the inner pipes.

4. An exhaust manifold for an engine according to claim 3, wherein a heat-resistant buffer member is inserted between each of the inner pipes and the corresponding outer pipe of of each of the exhaust pipes.

5. An exhaust manifold for an engine according to claim 4, wherein the heat-resistant buffer member is made of a wire net.

6. An exhaust manifold for an engine according to claim 1, wherein a curved portion of the bell mouth is formed in such a manner that an angle formed by two lines perpendicular to tangential lines at a starting point and an ending point of the curved portion is in the range of 45° to 75°.

7. An exhaust manifold for an engine according to claim 1, wherein the bell mouth of at least one of the exhaust pipes has an irregularly expanding peripheral portion.

8. An exhaust manifold for an engine according to claim 1, further comprising a catalyst arranged downstream of the oxygen sensor, wherein an axial line of each of the exhaust pipes is inclined with respect to a center line of the merging case.

9. An exhaust manifold for an engine comprising:

a merging case;

a plurality of exhaust pipes, each of the exhaust pipes having a connected end connected to a corresponding exhaust port of the engine and a connecting portion at a downstream end, the connecting portion of each exhaust pipe being connected to a inner wall surface of the merging case;

an oxygen sensor positioned in the merging case downstream of the connecting portions of the exhaust pipes, wherein the downstream end of each of the exhaust pipes is shaped as a bell mouth for leading exhaust gas to the oxygen sensor;

a guide member having a plurality of through holes aligned with exhaust gas passages of the exhaust pipes is mounted on the inner wall surface of the merging case, wherein each of the through holes is formed in the shape of a bell mouth for leading exhaust gas to the oxygen sensor.

10. An exhaust manifold for an engine according to claim 9, wherein the bell mouth of at least one of the exhaust pipes has an irregularly expanding peripheral portion.

11. An exhaust manifold for an engine according to claim 9, further comprising a catalyst arranged downstream of the oxygen sensor, wherein an axial line of each of the exhaust pipes is inclined with respect to a center line of the merging case.

* * * * *